US007009153B2

(12) United States Patent
Tomatsu

(10) Patent No.: US 7,009,153 B2
(45) Date of Patent: Mar. 7, 2006

(54) THERMAL FIXING DEVICE AND IMAGE FORMING APPARATUS

(75) Inventor: Yoshiya Tomatsu, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 25 days.

(21) Appl. No.: 10/773,337

(22) Filed: Feb. 9, 2004

(65) Prior Publication Data

US 2004/0222214 A1 Nov. 11, 2004

(30) Foreign Application Priority Data

Feb. 10, 2003 (JP) ..... 2003-032179

(51) Int. Cl.
*H05B 1/02* (2006.01)

(52) U.S. Cl. ..... 219/494; 219/216; 219/507

(58) Field of Classification Search ..... 219/618–619, 219/635, 469, 637–638, 647, 659–661, 663, 219/665, 667, 668, 216, 494, 507, 510; 337/354, 337/372, 380
See application file for complete search history.

(56) References Cited

U.S. PATENT DOCUMENTS

| | | | | |
|---|---|---|---|---|
| 4,794,364 | A | 12/1988 | Uehara | 337/354 |
| 5,420,392 | A * | 5/1995 | Sakata | 219/469 |
| 6,617,951 | B1 * | 9/2003 | Wang | 337/37 |

FOREIGN PATENT DOCUMENTS

| | | |
|---|---|---|
| JP | B2 6-8869 | 2/1994 |
| JP | A 8-297430 | 11/1996 |
| JP | A 9-114317 | 5/1997 |
| JP | B2 3209883 | 7/2001 |

* cited by examiner

*Primary Examiner*—Tu Hoang
(74) *Attorney, Agent, or Firm*—Oliff & Berridge, PLC

(57) ABSTRACT

A heat roller with which a pressure roller is brought into press contact is rotatably supported by a bearing member made of a material which is softened when heated above a thermal fixation temperature, a thermostat in which a bimetal is exposed toward the heat roller is disposed at the opposite side of the heat roller with respect to the pressure roller, and a heat conduction member is made to intervene between the heat roller and the bimetal. According to the above configuration, the power supply to a fixation heater can be cut off by the thermal deformation of the bimetal. The heat roller is moved by softening of the bearing member, and the bimetal is mechanically deformed by pressing of the heat conduction member. Therefore, the power supply to the fixation heater can be cut off.

69 Claims, 7 Drawing Sheets

THERMAL FIXING DEVICE AND IMAGE FORMING APPARATUS

FIELD OF THE INVENTION

The present invention relates to a thermal fixing device and an image forming apparatus including the thermal fixing device.

DESCRIPTION OF THE RELATED ART

An image forming apparatus such as a laser printer is generally provided with a thermal fixing device including a heat roller and a pressure roller, and a toner transferred on a sheet is thermally fixed during a period when the sheet passes through between the heat roller and the pressure roller.

The heat roller of the thermal fixing device as stated above generally includes a heater along its axial direction, and a thermal cutoff device for preventing the overheat of the heat roller due to the heater is provided around the heat roller.

The thermal cutoff device as stated above is provided as, for example, a thermostat including a bimetal deformed by heat, and the bimetal is thermally deformed by the overheat, so that power supply to the heater is cut off.

For example, there is proposed in JP-B-6-008869 that a bimetal disk is attached to a lower end of a disk holding stand, and is fixed by a pawl of a fixed cap from its outside, so that most of the bimetal disk is directly exposed toward a heat source, and the responsiveness of the thermostat is improved. There is a United States Application corresponding to JP-A-6-008869, and the Patent Number thereof is U.S. Pat. No. 4,794,364.

However, in the thermostat disclosed in JP-B-6-008869, since a heat roller and the bimetal disk are not in contact with each other, the heat from the heat roller is conducted to the bimetal disk through air having a low thermal conductivity, and accordingly, there is a limit in the improvement of the responsiveness.

SUMMARY OF THE INVENTION

It is therefore an object of the invention is to provide a thermal fixing device in which responsiveness to the overheat of a fixing member is improved, and power supply to a heating unit can be certainly cut off, and an image forming apparatus including the thermal fixing device.

In order to achieve the object, according to a first aspect of the invention, there is provided a thermal fixing device including: a fixing member disposed to be in contact with a fixation medium; a heating unit configured to heat the fixing member with power supplied thereto; a supporting unit configured to movably support the fixing member and to move the fixing member when the fixing member is overheated by the heating unit; a switch disposed to be in contact with the fixing member when the fixing member is moved by the supporting unit, and configured to mechanically cut off the power supplied to the heating unit when the switch contacts with the fixing member; and a thermal cutoff unit having a bimetal in which deforms by heat, disposed to face the fixing member, and configured to cut off the power supplied to the heating unit by deformation of the bimetal.

According to a second aspect of the invention, there is provided an thermal fixing device including: a fixing member disposed to be in contact with a fixation medium; a heating unit configured to heat the fixing member with power supplied thereto; and a thermal cutoff unit having a bimetal that is deformed by heat and exposed toward the fixing member to be in contact therewith without intermediary of air, and configured to cut off the power supplied to the heating unit by deformation of the bimetal.

According to a third aspect of the invention, there is provided an image forming apparatus including: a sheet feeding section configured to feed a sheet; and an image forming section configured to form an image on the sheet fed by the sheet feeding section, wherein the image forming section includes a thermal fixing device including: a fixing member disposed to be in contact with the sheet; a heating unit configured to heat the fixing member with power supplied thereto; a supporting unit configured to movably support the fixing member and to move the fixing member when the fixing member is overheated by the heating unit; a switch disposed to be in contact with the fixing member when the fixing member is moved by the supporting unit, and configured to mechanically cut off the power supplied to the heating unit when being contacted with the fixing member; and a thermal cutoff unit having a bimetal in which deforms by heat, disposed to face the fixing member, and configured to cut off the power supplied to the heating unit by deformation of the bimetal.

According to a fourth aspect of the invention, there is provided an image forming apparatus including: a sheet feeding section configured to feed a sheet; and an image forming section configured to form an image on the sheet fed by the sheet feeding section, wherein the image forming section includes a thermal fixing device including: a fixing member disposed to be in contact with the sheet; a heating unit configured to heat the fixing member with power supplied thereto; and a thermal cutoff unit having a bimetal that is deformed by heat and exposed toward the fixing member to be in contact therewith without intermediary of air, and configured to cut off the power supplied to the heating unit by deformation of the bimetal.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

Referring now to the accompanying drawings, a description will be given in detail of a preferred embodiment of the invention.

Figure 1:
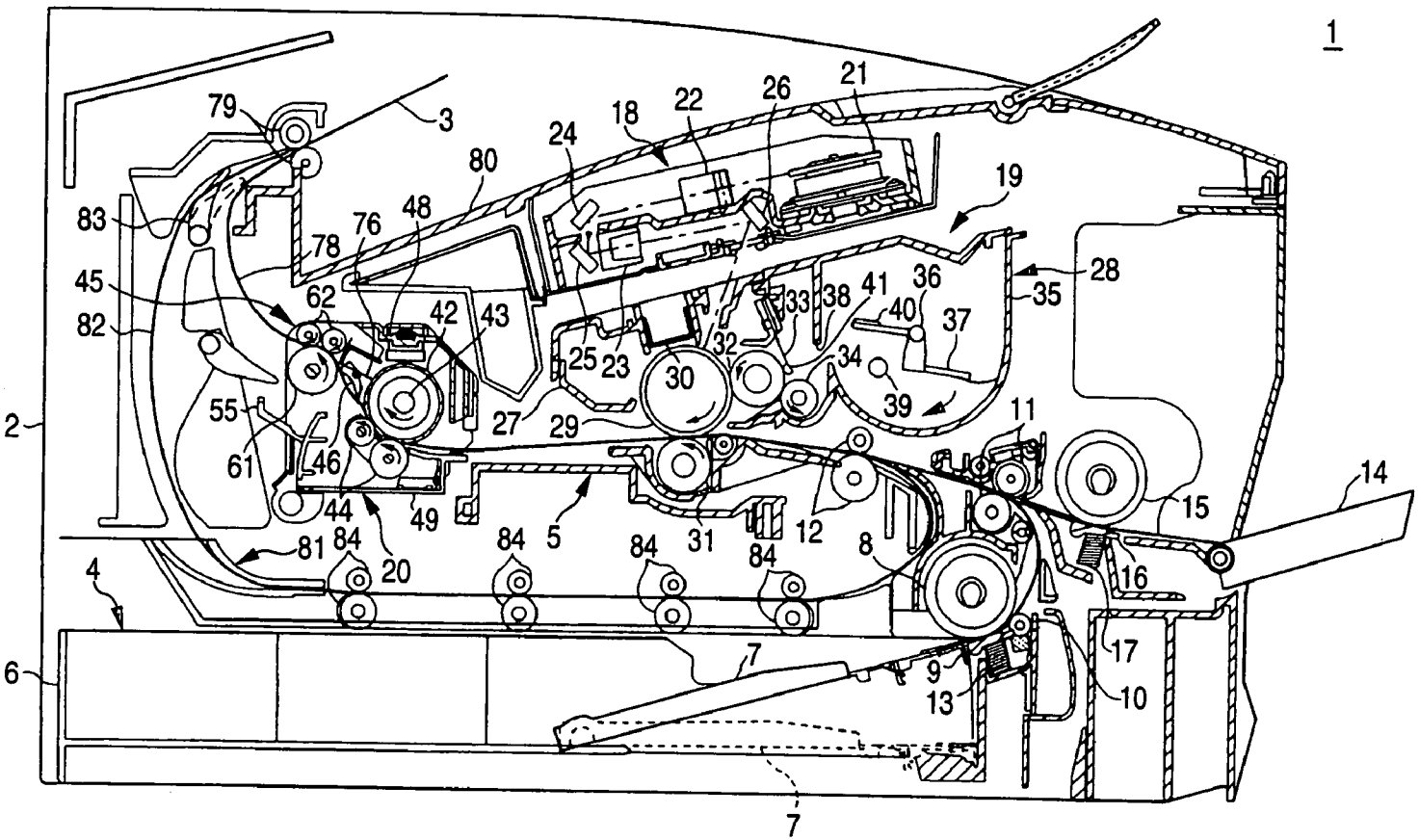
FIG. 1 is a main part sectional side view showing an embodiment of a laser printer as an image forming apparatus according to the present invention.

FIG. 1 is a main part side sectional view showing the preferred embodiment of a laser printer as an image forming apparatus according to the invention. As shown in FIG. 1, a laser printer 1 includes a sheet feeding section 4 for feeding a sheet 3 as a fixation medium, an image forming section 5 for forming an image on the fed sheet 3, and other components in a main body casing 2.

The sheet feeding section 4 includes a sheet feed tray 6, a sheet press plate 7 provided in the sheet feed tray, a sheet feed roller 8 and a sheet feed pat 9 provided above one end of the sheet feed tray 6, paper dust removal rollers 10 and 11 provided at a conveyance direction downstream side of the sheet 3 (hereinafter, the conveyance direction downstream side of the sheet 3 is simply referred to as "conveyance direction downstream side", and the conveyance direction upstream side of the sheet 3 is simply referred to as "conveyance direction upstream side", and a description will be made) with respect to the sheet feed roller 8, and a registration roller 12 provided at the conveyance direction downstream side with respect to the paper dust removal rollers 10 and 11.

The sheet press plate 7 can be stacked with the sheets 3 in a laminate state, and is swingably supported at a farther end with respect to the sheet feed roller 8 so that a nearer end can be moved vertically, and is urged upward by a not-shown spring from its back side. Thus, as the amount of lamination of the sheets 3 is increased, the sheet press plate 7 is swung downward against the urging force of the spring, while the farther end with respect to the sheet feed roller 8 is made a fulcrum. The sheet roller 8 and the sheet pat 9 are disposed to face each other, and the sheet feed pat 9 is pressed to the sheet feed roller 8 by a spring 13 provided at the back side of the paper sheet pat 9.

The uppermost sheet 3 on the sheet press plate 7 is pressed against the sheet roller 8 from the back side of the sheet press plate 7 by a not-shown spring, and after the sheet is held between the sheet feed roller 8 and the sheet feed pat 9, the sheet feed roller 8 is rotated, so that the sheet is fed one by one. In the laser printer 1, after paper dust of the fed sheet 3 is removed by the paper dust removal rollers 10 and 11, the sheet is fed to the registration roller 12.

The registration roller 12 is constructed by a pair of rollers, and sends the sheet 3 to an image formation position after registration. Incidentally, the image formation position is a transfer position where a toner image on a photosensitive drum 29 is transferred to the sheet 3, and is, in the embodiment, a contact position between the photosensitive drum 29 and the transfer roller 31.

Besides, this sheet feeding section 4 includes a multipurpose tray 14, a multipurpose side sheet feed roller 15 for feeding the sheet 3 stacked on the multipurpose tray 14 and a multipurpose side sheet feed pat 16. The multipurpose side sheet feed roller 15 and the multipurpose side sheet feed pat 16 are disposed to face each other, and the multipurpose side sheet feed pat 16 is pressed to the multipurpose side sheet feed roller 15 by a spring 17 provided at the back side of the multipurpose side sheet feed pat 16. The sheet 3 stacked on the multipurpose tray 14 is held between the multipurpose side sheet feed roller 15 and the multipurpose side sheet feed pat 16 by the rotation of the multipurpose side sheet feed roller 15, and then, it is fed one by one. The fed sheet 3 is sent to the registration roller 12 after its paper dust is removed by the paper dust removal roller 11.

The image formation part 5 includes a scanner section 18, a process section 19, a fixing section 20 as a thermal fixing device, and other components.

The scanner section 18 is provided at an upper part in the main body casing 2, and includes a laser emission unit (not shown), a polygon mirror 21 driven to be rotated, lenses 22 and 23, reflecting mirrors 24, 25 and 26. A laser beam emitted from the laser emission unit and based on image data passes through or is reflected by the polygon mirror 21, the lens 22, the reflecting mirrors 24 and 25, the lens 23 and the reflecting mirror 26 in sequence as indicated by a chain line, and is irradiated on the surface of the photosensitive drum 29 of the process section 19 by high speed scanning.

The process section 19 is disposed below the scanner section 18, and includes, in a drum cartridge 27 detachably mounted to the main body casing 2, a development cartridge 28, the photosensitive drum 29, a Scorotron type charging unit 30, and the transfer roller 31.

The development cartridge 28 is detachably mounted to the drum cartridge 27, and includes a developing roller 32, a layer thickness regulating blade 33, a supply roller 34, and a toner hopper 35.

The toner hopper 35 is filled with, as a developing agent, a positive charging nonmagnetic one-component toner. As the toner, a polymerized toner is used which is obtained by copolymerizing a polymerizable monomer, for example, styrene monomer such as styrene, or acrylic monomer such as acrylic acid, alkyl (C1 to C4) acrylate, or alkyl (C1 to C4) metaacrylate by a well-known polymerization method such as suspension polymerization. The polymerized toner as stated above has roughly a spherical shape, its fluidity is very excellent, and high quality image formation can be achieved.

Incidentally, the toner as stated above is mixed with wax or a coloring agent such as carbon black, and is added with an additive such as silica in order to improve the fluidity. Particle diameter of the additive is about 6 $\mu$m to 10 $\mu$m.

The toner in the toner hopper 35 is agitated in a direction shown by an arrow in FIG. 1 (clockwise direction) by an agitator 37 supported by a rotation shaft 36 provided at the center of the toner hopper 35, and is discharged through a toner supply port 38 opening to the supply roller 34 from the toner hopper 35. Incidentally, both side walls of the toner hopper 35 are provided with windows 39 for detection of the residual amount of toner, and the residual amount of toner in the toner hopper 35 can be detected. The window 39 is cleaned by a cleaner 40 supported by the rotation shaft 36.

The supply roller 34 is rotatably disposed at a facing position of the opposite side to the toner hopper 35 with respect to the toner support port 38, and the developer roller 32 is rotatably disposed to face the supply roller 34. The supply roller 34 and the developer roller 32 are in contact with each other in such a state that they are respectively compressed in some degree.

The supply roller 34 is such that a roller made of conductive foam material covers a roller shaft made of metal, and is driven to be rotated in a direction shown by an arrow direction in FIG. 1 (counterclockwise direction) by a not-shown motor.

The developer roller 32 is a roller made of conductive rubber material covers a roller shaft made of metal. More specifically, the roller of the developing roller 32 is such that the surface of a roller main body made of conductive urethane rubber or silicone rubber containing carbon fine particles or the like is covered with a coat layer of urethane rubber or silicone rubber containing fluorine. Incidentally, at the time of development, a development bias is applied to the developing roller 32 from a not-shown power source, and the roller is driven to be rotated in a direction shown by an arrow in FIG. 1 (counterclockwise direction) by a not-shown motor.

The layer thickness regulating blade 33 is disposed in the vicinity of the developing roller 32. The layer thickness regulating blade 33 includes a press part 41 made of insulating silicone rubber and having a semicircular section at a tip part of a blade main body made of a metal plate spring member, and is supported by the development cartridge 28 in the vicinity of the developing roller 32, and the press part 41 is provided so as to be pressed onto the developing roller 32 by the elastic force of the blade main body.

The toner discharged from the toner supply port 38 is supplied to the developing roller 32 by the rotation of the supply roller 34, and is positively charged at this time by the friction between the supply roller 34 and the developing roller 32, and further, the toner supplied onto the developing roller 32 enters a space between the press part 41 of the layer thickness regulating blade 33 and the developing roller 32 in accordance with the rotation of the developing roller 32, and is supported as a thin layer having a specified thickness on the developing roller 32.

The photosensitive drum 29 is rotatably supported at a facing position of an opposite side of the supply roller 34 with respect to the developing roller 32 and in the drum cartridge 27. The photosensitive drum 29 includes a grounded dram main body, its surface is formed of a positively-charged photosensitive layer made of material such as polycarbonate, and the photosensitive drum is driven to be rotated in a direction shown by an arrow in FIG. 1 (clockwise direction) by a not-shown motor.

The Scorotron type charging unit 30 is disposed above and facing to the photosensitive drum 29. The Scorotrom type charging unit 30 is spaced from the photosensitive drum 29 by a specified interval so as not to come in contact therewith. The Scorotron type charging unit 30 is configured to be charged positive and to generate corona discharge from a charging wire made of material such as tungsten. The Scorotron type chaging unit 30 is provided to uniformly and positively charge the surface of the photosensitive drum 29 by application of voltage from a not-shown power source.

The transfer roller 31 is disposed below the photosensitive drum 29 to face the photosensitive drum 29, and is rotatably supported by the drum cartridge 27. The transfer roller 31 is a roller made of conductive rubber material covers a roller shaft made of metal, and at the time of transfer, a transfer bias is applied from a not-shown power source, and the transfer roller is driven to be rotated in a direction shown by an arrow in FIG. 1 (counterclockwise direction) by a not-shown motor.

The surface of the photosensitive drum 29 is charged uniformly and positively by the Scorotron type charging unit 30, and then, an electrostatic latent image is formed by a laser beam irradiated by the scanner section 18, and then, when the photosensitive drum faces the developing roller 32, and when the toner supported on the developing roller 32 and positively charged faces and comes in contact with the photosensitive drum 29 by the rotation of the developing roller 32, the toner is supplied to the electrostatic latent image formed on the surface of the photosensitive drum 29, that is, to the exposed portion of the uniformly positively charged photosensitive drum 29, which is exposed by the laser beam and whose potential is lowered, and the toner is selectively supported, so that the toner image is formed, whereby a reversal development is achieved.

Thereafter, the toner image supported on the surface of the photosensitive drum 29 is transferred to the sheet 3 by a transfer bias applied to the transfer roller 31 while the sheet 3 passes through between the photosensitive drum 29 and the transfer roller 31.

Figure 2:
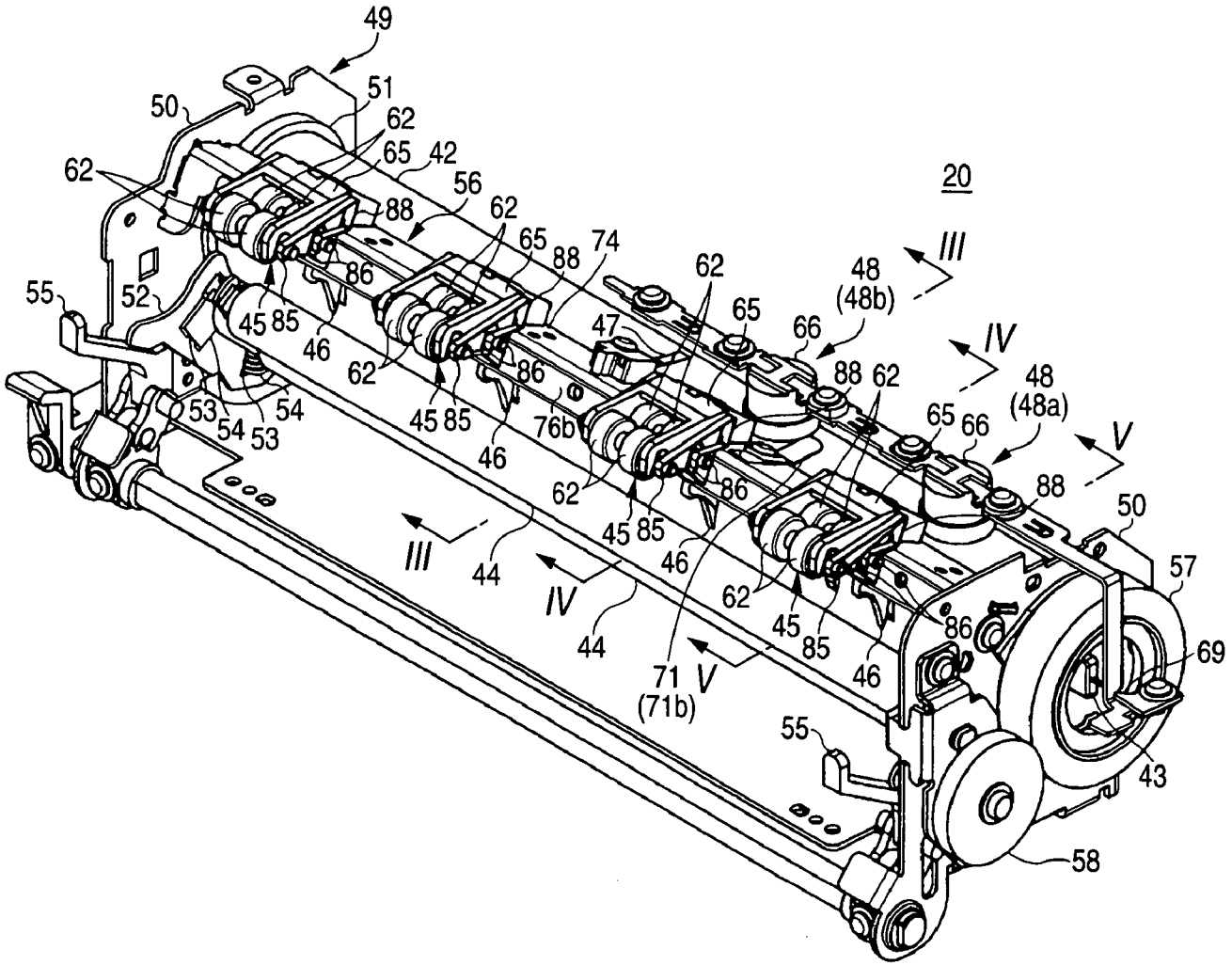
FIG. 2 is a main part perspective view of a fixing part of the laser printer shown in FIG. 1.
Figure 3:
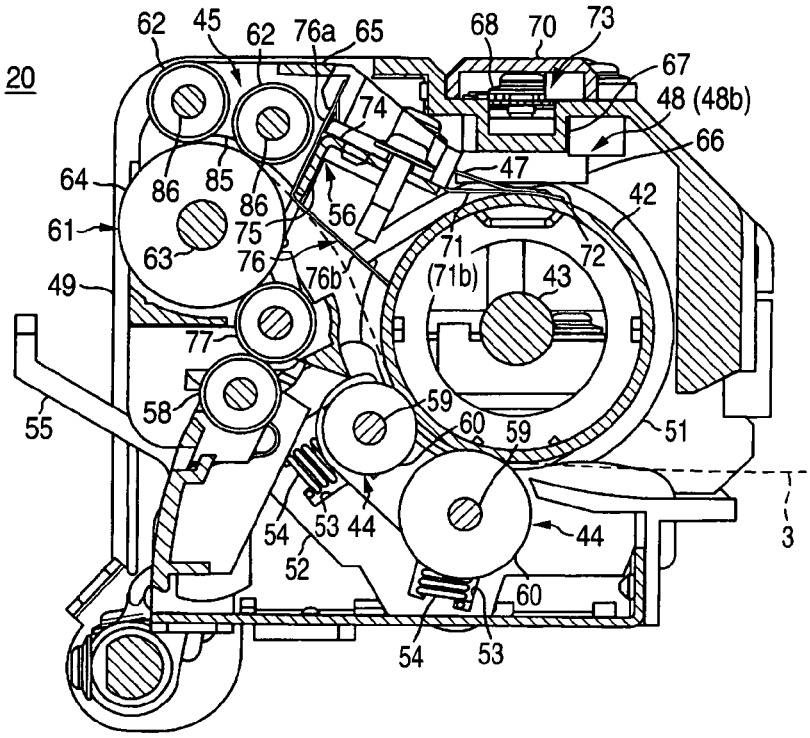
FIG. 3 is a sectional view taken along line III—III of FIG. 2 in the laser printer.

The fixing section 20 is disposed at the conveyance direction downstream side with respect to the process part 19, and includes, as shown in FIGS. 2 and 3, a heat roller 42 as the fixing member and the fixing roller, a fixation heater 43 as the heating unit, plural, two in this embodiment, pressure rollers 44 as the press member, a conveyance mechanism section 45, plural, four in this embodiment, peeling pawls 46 (see FIG. 5), a thermistor 47, and plural, two in this embodiment, thermostats 48 as the thermal cutoff unit, and these are supported by a fixation frame 49 as the supporting unit.

As shown in FIG. 2, the fixation frame 49 includes a pair of support plates 50 holding the heat roller 42 in an axial direction and facing each other, and bearing members 51 for rotatably supporting the heat roller 42 are provided at the respective support plates 50. Each of the bearing members 51 is formed into a ring shape having an inner diameter corresponding to an outer diameter of the heat roller 42 so that the outer peripheral surface of the heat roller 42 can be rotatably received. Each of the bearing members 51 is formed of material (for example, polyphenylene sulfide: melting point of 280° C.) which is softened when the temperature exceeds the thermal fixation temperature (for example, 220° C.) at which the toner image transferred on the sheet 3 is thermally fixed.

An pressure roller support plates 52 for supporting the plural pressure rollers 44 are provided on the respective support plates 50. Pressure roller attachment grooves 53 corresponding to the respective pressure rollers 44 are respectively formed in the respective pressure roller support plates 52. Springs 54 are respectively provided in the respective pressure roller attachment grooves 53. One end of each of the springs 54 is fixed to the pressure roller attachment groove 53, and the other end is attached to a roller shaft 59 of the pressure roller 44.

The respective pressure roller support plates 52 are swingably provided to the respective support plates 50, press levers 55 swingably supported to the respective support plates 50 engage with the pressure roller support plates 52, and the respective press levers 55 are swung so that the respective pressure roller support plates 52 are swung, and by this, press contact and its release of the respective pressure rollers 44 to the heat rollers 42 are performed.

This fixation frame 49 includes an erection frame 56 provided between the respective support plates 50.

As shown in FIG. 3, the erection frame 56 is disposed between the heat roller 42 and an after-mentioned conveyance roller 61 in the conveyance direction of the sheet 3, and has a substantially L-letter shaped section in which a horizontal cover 74 and a vertical cover plate 75 formed to be bent substantially perpendicularly to the horizontal cover plate 74 are integrally formed. In a state where a free end part of the horizontal cover plate 74 faces an upper part of the heat roller 42, and a free end of the vertical cover plate 75 faces a side of the conveyance roller 61 at the conveyance direction upstream side, as shown in FIG. 2, the erection frame is supported between the respective support plates 50 so that its longitudinal direction becomes parallel to the axial direction of the heat roller 42.

The erection frame 56 is provided with a first guide member 76. The first guide member 76 is made of a metal steel plate extending along the axial direction of the heat roller 42, has a flat plate shape with a substantially L-letter shaped section in which a support piece 76*a* and a guide piece 76*b* are integrally formed, and is disposed between the heat roller 42 and the conveyance roller 61. The first guide member 76 is disposed so that the support piece 76*a* is connected to the vertical cover plate 75, a conveyance direction upstream side free end of the guide piece 76*b* faces the surface of the heat roller 42, and a conveyance direction downstream side base part thereof (continuous portion with the support piece 76*a*) faces the surface of the conveyance roller 61.

Although the first guide member 76 is provided in the facing state along the axial direction of the heat roller 42, not-shown openings for exposing the peeling pawls 46 are formed in the guide piece 76*b* at positions where the after-mentioned peeling pawls 46 are provided.

The erection frame 56 is provided with, as shown in FIG. 2, a pinch roller support part 65 for supporting an after-mentioned pinch roller 62 of the conveyance mechanism section 45. Plural, four in this embodiment, such pinch roller support parts 65 are provided along the axial direction of the heat roller 42 at specified intervals.

Figure 5:
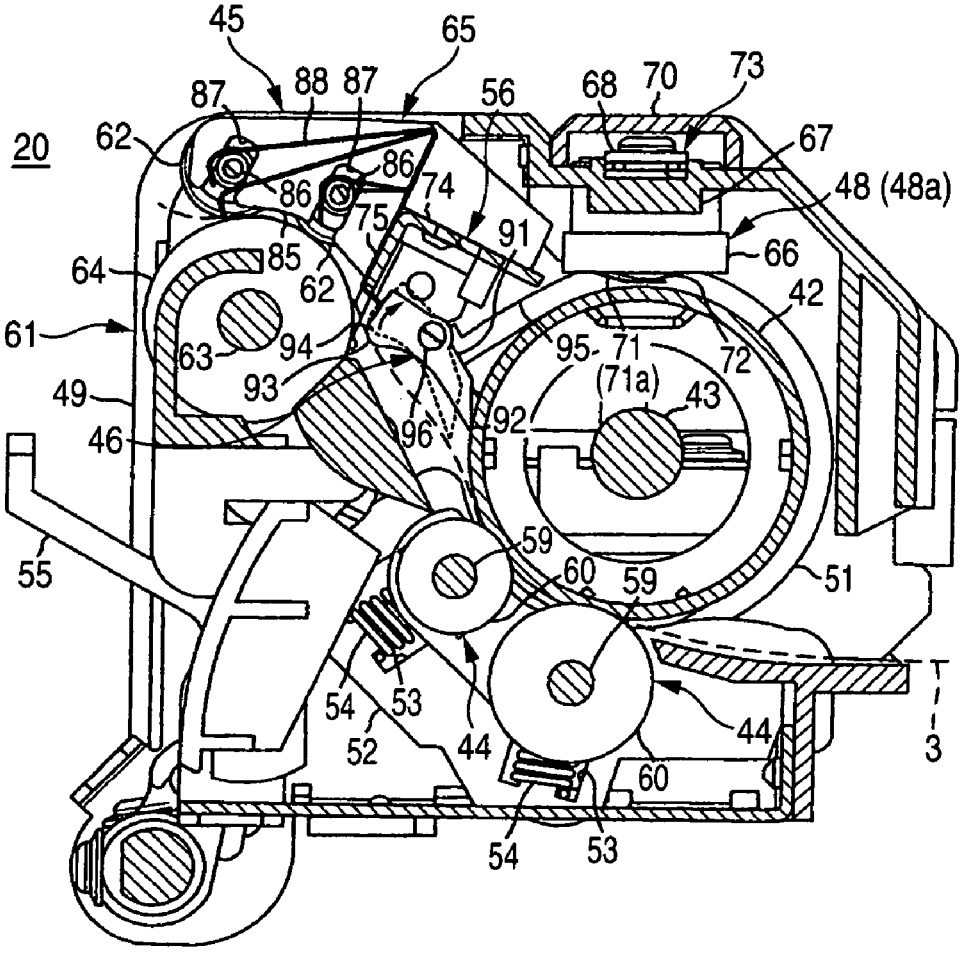
FIG. 5 is a sectional view taken along line V—V of FIG. 2 in the laser printer.

Each of the pinch roller support parts 65 is formed to be substantially C-letter shaped when viewed on a plane, and includes second guide members 85 made of resin and disposed to face each other while being spaced from each other by a specified interval. Each of the second guide members 85 is formed to protrude like a plate toward the conveyance direction downstream side from the vertical cover plate 75 of the erection frame 56, and is formed above the conveyance roller 61 to have, as shown in FIG. 5, a curved shape along the surface of the conveyance roller 61.

In each of the second guide members 85, two support grooves 87 for receiving a support shaft 86 for supporting the pinch roller 62, which will be described later, are formed to have a substantially U-letter shaped form opening to the lower part when viewed laterally while being spaced from each other along the conveyance direction of the sheet 3 by a specified interval.

In the fixation frame 49, as shown in FIG. 2, the one support plate 50 is provided with a heat roller drive gear 57 for externally mating with the bearing member 51, and an input gear 58 which is disposed at the side of the heat roller drive gear 57 to engage with the heat roller drive gear 57 and to which power from a not-shown motor is inputted. Incidentally, a transmission gear 77 (see FIG. 3) engaging with the input gear 58 and a not-shown conveyance roller drive gear provided at a roller shaft 63 of the conveyance roller 61 is provided at a position where overlaps with the input gear 58 in the axial direction of the heat roller 42.

The heat roller 42 is formed into a cylinder shape by draw molding of metal such as aluminum, and both ends in the axial direction are press inserted in the respective bearing members 51. When power is inputted from a not-shown motor through the input gear 58 and the heat roller drive gear 57, the heat roller 42 is rotated in a direction shown by an arrow shown in FIG. 7 (clockwise direction).

The fixation heater 43 in which made of a halogen heater or the like for generating heat by energization, is disposed at the axial core in the heat roller 42, and is provided along the axial direction of the heat roller 42 in order to heat the heat roller 42. The fixation heater 43 is controlled to be ON or OFF by a not-shown CPU at the time of fixation, and the surface of the heat roller 42 is kept at a set thermal fixation temperature. Incidentally, a wiring 69 to which power is applied from a not-shown power source is connected to the fixation heater 43.

As shown in FIG. 3, the plurality of pressure rollers 44 (two in the embodiment) are provided below the heat roller 42 so as to face the heat roller 42 along the conveyance direction of the sheet 3. Each of the pressure rollers 44 is such that a roller 60 made of heat resistant rubber material covers the roller shaft 59 made of metal, and as shown in FIG. 2, respective shaft ends of the roller shaft 59 are inserted in the pressure roller attachment grooves 53 of the respective pressure roller support plates 52, and are respectively supported in a state where springs 54 are attached. In a state where the press lever 55 is swung in a direction of pressing the respective pressure rollers 44 to the heat roller 42, the roller shaft 59 is urged by the spring 54, so that the pressure roller 44 is pressed to the heat roller 42. Incidentally, when the heat roller 42 is driven to be rotated, the respective pressure rollers 44 are rotated in a direction shown by an arrow in FIG. 7 (counterclockwise direction) in accordance with the rotation driving of the heat roller 42. Incidentally, in the following description, in the case where the respective pressure rollers 44 are differentiated from each other, they are differentiated by an upstream side pressure roller 44*a* and a downstream side pressure roller 44*b* along the conveyance direction of the sheet 3.

As described above, in a case where the plural pressure rollers 44 are provided, since the sheet 3 can be pressed to the heat roller 42 by those plural pressure rollers 44, the contact area of the sheet 3 to the heat roller 42 can be increased. Thus, the sheet 3 can be quickly and certainly fixed, and speedup of thermal fixation (for example, about 100 mm/sec in terms of printing speed) and miniaturization can be realized.

The conveyance mechanism section 45 is disposed at the conveyance direction downstream side with respect to the heat roller 42 and the pressure roller 44, and includes the conveyance roller 61 and the plural pinch rollers 62 disposed above the conveyance roller 61 to face thereto.

As shown in FIG. 3, the conveyance roller 61 is such that an elastic roller 64 made of rubber material covers the roller shaft 63 made of metal, and is disposed to face the heat roller 42 through the erection frame 56 in the conveyance direction of the sheet 3, and although not shown in FIG. 2, the roller shaft 63 is inserted in the respective support plates 50, so that the conveyance roller is rotatably supported between the support plates 50 along the axial direction of the heat roller 42.

When power is inputted from the not-shown motor through the input gear 58, the transmission gear 77 and the not-shown conveyance roller drive gear, the conveyance roller 61 is driven to be rotated in the arrow direction (counterclockwise direction).

As shown in FIG. 2, in each of the pinch roller support parts 65 of the fixation frame 49, a plurality of pairs, two pairs in the embodiment, of pinch rollers 62 are provided to successively face and come in contact with the conveyance roller 61 from above in the conveyance direction of the sheet 3.

Figure 7:
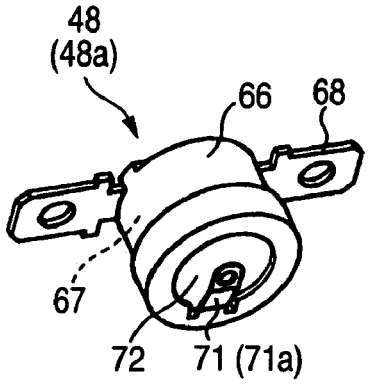
FIG. 7 is a perspective view showing a first thermostat.
Figure 8:
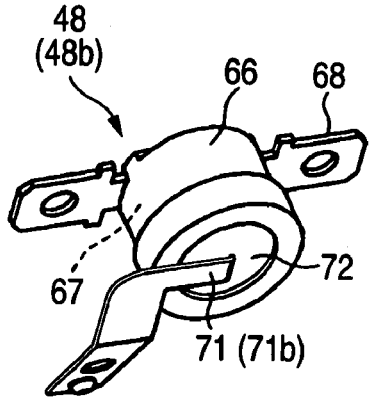
FIG. 8 is a perspective view showing a second thermostat.

That is, as shown in FIG. 8, between the second guide members 85 of the pinch roller support part 65 facing each other, two support shafts 86 are received in respective support grooves 87 and are supported by an engagement tool 88 rotatably and movably in the vertical direction. The two pinch rollers 62 are provided side by side as one pair in the axial direction to the respective support shafts 86. Incidentally, when the conveyance roller 61 is driven to be rotated, each of the pinch rollers 62 is rotated in a direction shown by an arrow in FIG. 7 (clockwise direction) in accordance with the rotation driving of the conveyance roller 61.

In the conveyance mechanism section 45, the rotation speed of the conveyance roller 61 is slightly higher than the rotation speed of the heat roller 42, so that the speed at which the sheet 3 is conveyed by the conveyance roller 61 and the pinch rollers 62 becomes slightly higher than the speed at which the sheet 3 is conveyed by the heat roller 42 and the pressure rollers 44, and in the embodiment, when the rotation speed of the heat roller 42 is made 100%, the rotation speed of the conveyance roller 61 is set to exceed 100% and not to be larger than approximately 103%.

As shown in FIG. 2, at positions where the respective pinch-roller support parts 65 are provided at the erection frame 56 of the fixation frame 49, as shown in FIG. 5, a plurality of, four in the embodiment, peeling pawls 46 are provided to swing and to be capable of coming in contact with and separating from the heat roller 42 in a state where they face the heat roller 42 from the conveyance direction downstream side to the upstream side.

Each of the peeling pawls 46 includes a pawl main body 91, a tip portion 92 coming in contact with the surface of the heat roller 42, a contact portion 93 coming in contact with the sheet 3 peeled off from the heat roller 42 and for separating the tip portion 92 from the surface of the heat roller 42, and a guide portion 94 for guiding the peeled sheet 3 to the conveyance mechanism section 45, and is integrally formed by, for example, integral molding of heat resistant resin such as polyphenylene sulfide (PPS).

Each of the peeling pawls 46 is swingably provided through the swing shaft 96 to a peeling pawl attachment plate 95, which is formed to protrude downward from the erection frame 56, at a position where the pinch roller support part 65 of the erection frame 56 is provided and at such a position that the center of gravity is disposed so that the tip portion 92 is usually in contact with the surface of the heat roller 42 by its own weight. According to the above configuration, the tip portion 92 is disposed to come in contact with the surface of the heat roller 42 from the counter direction of the rotation direction of the heat roller 42 at the downstream side of the contact portion between the heat roller 42 and the pressure roller 44 at the conveyance direction downstream side in the rotation direction of the heat roller 42.

The thermistor 47 is a contact type temperature sensor, and is formed, as shown in FIG. 2, into a flat rectangular shape having elasticity, and at the upstream side of the contact portion between the heat roller 42 and the upstream side pressure roller 44*a* in the rotation direction of the heat roller 42 and at the center portion of the heat roller 42 in the axial direction, its base end is supported at the side cover plate 74 of the erection frame 56 of the fixation frame 49 so that its free end comes in contact with the surface of the heat roller 42.

The thermistor 47 detects the surface temperature of the heat roller 42 and inputs a detection signal to a not-shown CPU, and the CPU controls the drive and stop of the fixation heater 43 on the basis of the detection signal from the thermistor 47, and keeps the surface temperature of the heat roller 42 at a set thermal fixation temperature.

The plural, two in the embodiment, thermostats 48 are provided above the opposite side of the heat roller 42 with respect to the pressure roller 44, at the upstream side of the contact portion between the heat roller 42 and the respective pressure rollers 44 in the rotation direction of the heat roller 42, and to overlap with the heat roller along the axial direction. Incidentally, in the following description, in the case where the respective thermostats 48 are differentiated from each other, the thermostat 48 disposed at the outside in the axial direction of the heat roller 42 is called a first thermostat 48*a*, and the thermostat 48 disposed at the inside in the axial direction is called a second thermostat 48*b*.

The first thermostat 48*a* is disposed at the conveyance direction upstream side to face the pinch roller support part 53 at the outermost side in the axial direction of the heat roller 42, and is supported by a cover member 70 (see FIG. 5) covering the upper part of the fixation frame 49. Besides, the second thermostat 48*b* is disposed at the conveyance direction upstream side to face the pinch roller support part 53 adjacent, at the inside in the axial direction of the heat roller 42, to the pinch roller support part 53 facing the first thermostat 48*a*, and is supported by the cover member 70 (see FIG. 3) covering the upper part of the fixation frame 49.

Both the first thermostat 48*a* and the second thermostat 48*b* are disposed to face the fixation area of the heat roller 42, which comes in contact with the image area of the sheet 3 in which a toner image is formed.

Figure 4:
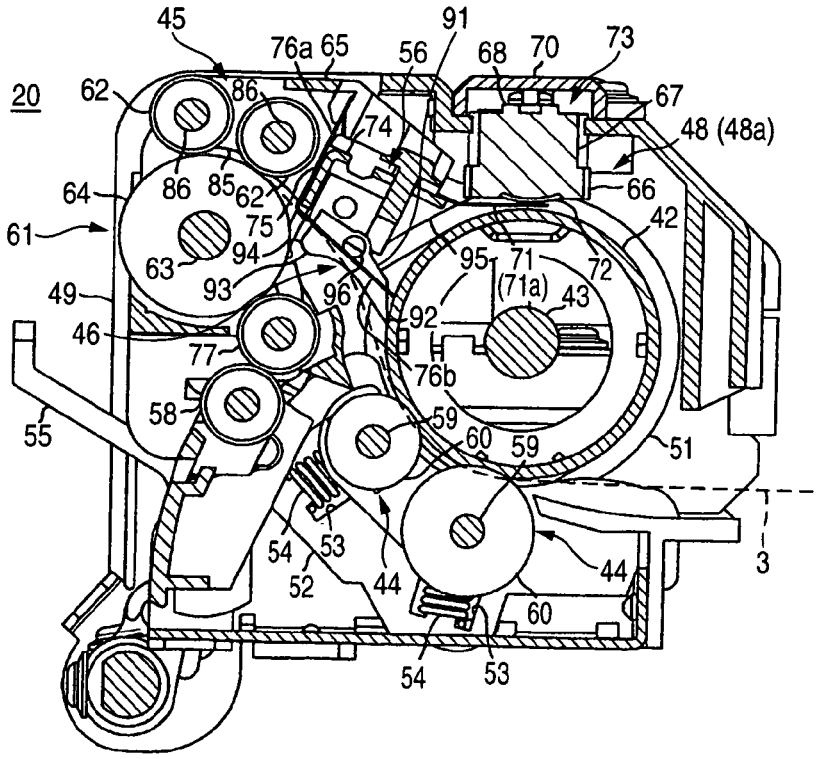
FIG. 4 is a sectional view taken along line IV—IV of FIG. 2 in the laser printer.

As shown in FIG. 4, each of the thermostats 48 includes a bimetal casing 66 as the housing and a bimetal 67 housed in the bimetal casing 66.

The bimetal casing 66 has a cylindrical shape with a bottom and an opening at its lower part, and at its upper part, a contact point 73 is formed which is usually in a separate state with respect to the bimetal 67 and comes in contact with, when the bimetal 67 is thermally deformed, the thermally deformed bimetal 67.

The bimetal 67 is made of metal deformed by heat, for example, alloy thermally deformed when a temperature exceeds a thermal fixation temperature (for example, 220° C.) by 10° C. to 30° C. The bimetal 67 is exposed toward the heat roller 42 in a facing state from the opening lower part of the bimetal casing 66, and a projection member 72 as the projection part curvedly projecting from the bimetal casing 66 to the surface of the heat roller 42 is provided on the exposed surface.

In the fixation frame 49, as shown in FIG. 2, a conduction plate 68 connected to the contact point 73 of each of the thermostats 48 is provided. The conduction plate 68 is formed to have a substantially L-letter shaped bend, its one side with respect to the bent part is extended above the heat roller 42 along the axial direction of the heat roller 42 and is successively connected to the contacts 73 of the respective thermostats 48, and the other side with respect to the bent part is extended to face the one bearing member 51 and is connected to a wiring 69 connected to the fixation heater 43.

The conduction plate 68 is connected to a not-shown power source so that the contact with the contact point 73 triggers the flow of an excess current for cutting off the power supply of the wiring 69.

A heat conduction member 71 intervening between the bimetal 67 and the heat roller 42 and coming in contact with those surfaces, as the switch unit and the member having the high thermal conductivity, is provided in each of the thermostats 48.

Each of the heat conduction members 71 is supported at, for example, as shown in FIG. 3, the downstream side of each of the thermostats 48 in the conveyance direction of the sheet 3.

Figure 6:
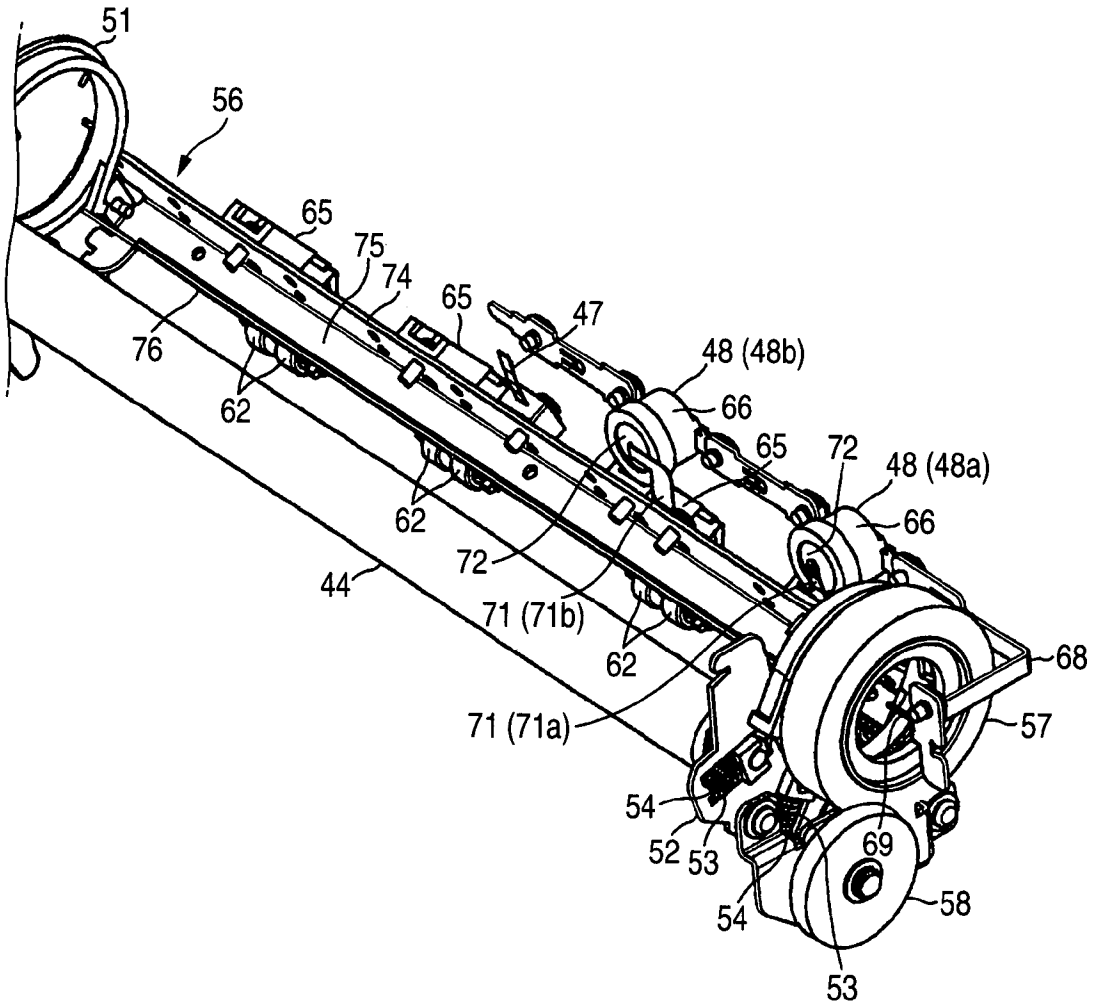
FIG. 6 is a main part perspective view showing a state where a support plate and a heat roller are not mounted.

More specifically, the first thermostat 48*a* is provided with a first heat conduction member 71*a*. As shown in FIGS. 6 and 7, the first heat conduction member 71*a* is a substantially rectangular flat plate having elasticity, and is disposed so that its base end is fixed to the lower part of the bimetal casing 66, and its free end comes in contact with the surface of the projection member 72 of the bimetal 67 exposed from the bimetal casing 66.

The second thermostat 48*b* is provided with a second heat conduction member 71*b*. As shown in FIGS. 6 and 8, the second heat conduction member 71*b* is a substantially L-letter shaped flat plate having elasticity, and is disposed so that its base end is screwed, as shown in FIG. 2, to the erection frame 56 of the fixation frame 49 at the outside of the pinch roller support part 53 facing the second thermostat 48*b* in the axial direction of the heat roller 42, and its free end is in contact with the surface of the projection member 72 of the bimetal 67 exposed from the bimetal casing 66.

As shown in FIG. 5, in a normal state (a state which is not an overheat state, which will be described later), the first heat conduction member 71*a* is disposed so that its front surface is always in contact with the projection member 72 of the bimetal 67 of the first thermostat 48*a*, and its back surface faces the surface of the heat roller 42 in the fixation area of the heat roller 42 while being usually spaced therefrom by a slight gap. As shown in FIG. 4, in the normal state, the second heat conduction member 71*b* is disposed so that its front surface is always in contact with the projection member 72 of the bimetal 67 of the second thermostat 48*b*, and its back rear surface faces the surface of the heat roller 42 in the fixation area of the heat roller 42 while being usually spaced by a slight gap.

The heat conduction member 71 is formed of a material having a higher thermal conductivity than air, for example, phosphor bronze, gold, silver, copper, iron, or stainless steel, and is preferably formed of phosphor bronze which is excellent in the thermal conductivity and spring properties.

In the fixing section 20, as shown in FIG. 1, a toner image transferred on the sheet 3 is fixed during a period when the sheet 3 conveyed from the transfer position successively passes through while being held between the heat roller 42 and the plural pressure rollers 44, and then, the sheet 3 is conveyed in the conveyance mechanism section 45 while being held between the conveyance roller 61 and the pinch roller 62, and is conveyed to a paper ejection path 78.

At this time, in the fixing section 20, as shown in FIG. 5, the front end (conveyance direction downstream side end) of the sheet 3 having passed through between the heat roller 42 and the conveyance direction downstream side pressure roller 44*b* first comes in contact with the tip portion 92 of the peeling pawl 46 being usually in contact with the heat roller 42, and is peeled off from the surface of the heat roller 42. Subsequently, the front end of the sheet 3 peeled off from the surface of the heat roller 42 comes in contact with the contact portion 93 of the peeling pawl 46, and reaches the conveyance mechanism section 45 while being guided by the guide portion 94, and in the conveyance mechanism section 45, the sheet is conveyed while being held between the conveyance roller 61 and the pinch roller 62.

At this time, the sheet 3 is held between the heat roller 42 and the respective pressure rollers 44 at the conveyance direction upstream side, and is held between the conveyance roller 61 and the respective pinch rollers 62 at the conveyance direction downstream side, and accordingly, a tensile force is given between those. Then, since the contact portion 93 of the peeling pawl 46 coming in contact with the sheet 3 is pressed by the tensile force toward the direction opposite to the projection direction from the pawl main body 91, that is, obliquely upward, and as a result, the peeling pawl 46 is swung in the clockwise direction while the swing shaft 96 is made a fulcrum, and the tip portion 92 is separated from the surface of the heat roller 42.

Thereafter, when the rear end of the sheet 3 passes through between the heat roller 42 and the conveyance direction downstream side pressure roller 44, since the tensile force of the sheet 3 is lost, the peeling pawl 46 is swung by its own weight so that the tip portion 92 again comes in contact with the surface of the heat roller 42.

As a result, in the fixing section 20, during the fixing operation, each time the sheet 3 passes through between the heat roller 42 and the conveyance direction downstream side pressure roller 44*b*, the tip portion 92 of the peeling pawl 46 can be separated from the surface of the heat roller 42.

Thus, even if a large expensive mechanism is not provided, by the simple structure, during the fixing operation, each time the sheet 3 passes through between the heat roller 42 and the downstream side pressure roller 44*b*, except when the need arises (that is, except when the front end of the sheet 3 passes through between the heat roller 42 and the conveyance direction downstream side pressure roller 44), the peeling pawl 46 can be separated from the heat roller 42 to the extent possible. As a result, during the fixing operation, as compared with the case where the peeling pawl 46 is always in contact with the heat roller 42, it is possible to reduce such disadvantage that the toner is deposited on the peeling pawl 46, the deposited toner is again adhered to the heat roller 42, and the sheet 3 is stained, or the heat roller 42 is worn down by the continuous contact during the fixing operation, and the durability is lowered.

More specifically, in the case where the sheet 3 is, for example, A4 size, except a period when the front end of about 30 mm of the sheet 3 passes through between the heat roller 42 and the conveyance direction downstream side pressure roller 44, and a period when the rear end of about 30 mm of the sheet 3 passes through between the heat roller 42 and the conveyance direction downstream side pressure roller 44*b*, the tip portion 92 of the peeling pawl 46 can be separated from the surface of the heat roller 42 in a period when the remaining intermediate part of 240 mm passes through between the heat roller 42 and the conveyance direction downstream side pressure roller 44.

Thereafter, as shown in FIG. 1, the sheet 3 sent to the paper ejection path 78 is sent to a paper ejection roller 79, and is ejected onto a paper ejection tray 80 by the paper ejection roller 79.

At this time, for example, even if the front end of the sheet 3 having passed through between the heat roller 42 and the conveyance direction downstream side pressure roller 44 has an arc-shaped curl in the same direction as the surface shape of the heat roller 42, as shown in FIG. 3, the front end of the sheet 3 having the curl first comes in contact with the guide piece 76*b* of the first guide member 76, and is guided to the conveyance position (contact portion between the conveyance roller 61 and the conveyance direction upstream side pinch roller 62, and the same shall apply hereinafter) of the sheet 3 in the conveyance mechanism section 45 by the guide piece 76*b* of the first guide member 76 in accordance with the sending out of the sheet 3 from between the heat roller 42 and the respective pressure rollers 44. At the conveyance direction upstream side of the conveyance position, the front end of the sheet 3 having the curl, especially its surface which is opposite to the surface brought into contact with the heat roller 42, next comes in contact with the conveyance roller 61, and the sheet is conveyed to the conveyance position while being flattened out in the reverse direction to the curl direction of the front end of the sheet 3 by the conveyance roller 61. Thus, while the occurrence of a jam due to the bending or the like of the sheet 3 is prevented, the sheet 3 can be certainly guided to the conveyance position.

As shown in FIG. 1, the laser printer 1 includes a reversal conveyance part 81 for the purpose of forming images on both sides of the sheet 3. This reversal conveyance part 81 includes the paper ejection roller 79, a reversal conveyance path 82, a flapper 83, and plural reversal conveyance rollers 84.

The paper ejection roller 79 is made of a pair of rollers, and is provided so that the forward rotation and the reverse rotation can be changed. As stated above, in the case where the sheet 3 is ejected onto the paper ejection tray 80, the paper ejection roller 79 is rotated in the forward direction, and in the case where the sheet 3 is reversed, the paper ejection roller 79 is rotated in the reverse direction.

The reversal conveyance path 82 is provided along the vertical direction so that the sheet 3 can be conveyed from the paper ejection roller 79 to the plural reversal conveyance rollers 84 disposed below the image formation part 5, its upstream side end is disposed near the paper ejection roller 79, and its downstream side end is disposed near the reversal conveyance roller 84.

The flapper 83 is swingably provided to face a branch portion between the paper ejection path 78 and the reversal conveyance path 82, and is provided to be capable of changing the conveyance direction of the sheet 3 reversed by the paper ejection roller 79 from the direction toward the paper ejection path 78 to the direction toward the reversal conveyance path 82 by excitation or non-excitation of a not-shown solenoid.

The plural reversal conveyance rollers 84 are provided above the sheet feed tray 6 in the substantially horizontal direction, the reversal conveyance roller 84 at the most upstream side is disposed near the rear end of the reversal conveyance path 82, and the reversal conveyance roller 84 at the most downstream side is disposed below the registration roller 12.

In a case where images are formed on both sides of the sheet 3, this reversal conveyance part 81 is operated as follows. That is, when the sheet 3 on one side of which an image is formed is sent by the conveyance mechanism section 45 from the paper ejection path 78 to the paper ejection roller 79, the paper ejection roller 79 is forward rotated in a state where it holds the sheet 3, and once conveys this sheet 3 to the outside (side of the paper ejection tray 80), and when most of the sheet 3 is sent to the outside and the rear end of the sheet 3 is held by the paper ejection roller 79, the forward rotation is stopped. Next, the paper ejection roller 79 is reversely rotated, the flapper 83 changes the conveyance direction so that the sheet 3 is conveyed to the reversal conveyance path 82, and the sheet 3 is conveyed to the reversal conveyance path 82 in a state where the front and the rear are reversed. Incidentally, when the conveyance of the sheet 3 is ended, the flapper 83 is changed into the original state, that is, the state in which the sheet 3 sent from the conveyance mechanism section 45 is sent to the paper ejection roller 79. Next, the sheet 3 reversely conveyed to the reversal conveyance path 82 is conveyed to the reversal conveyance rollers 84, and is sent from the reversal conveyance rollers 84 to the registration roller 12 while being reversed upward. The sheet 3 conveyed to the registration roller 12 is again sent, in the reversed state, to the image formation position after registration, and the images are formed on both the sides of the sheet 3 by the above configuration.

In the fixing section 20, the fixation heater 43 does not operate normally by an erroneous operation of a not-shown CPU or a circuit, and when the surface of the heat roller 42 is overheated up to a temperature exceeding the set fixation temperature (for example, 220° C.), and the surface of the heat roller 42 reaches the heat deformation temperature of the bimetal 67 exceeding the thermal fixation temperature by, for example, 10 to 30° C., the heat is conducted to the projection member 72 of the bimetal 67 of each of the thermostats 48 through each of the heat conduction members 71 disposed to face the heat roller 42 while being spaced therefrom by the slight gap, and the thermal deformation of the bimetal 67 occurs. Then, the bimetal 67 and the contact point 73 come in contact with each other by the thermal deformation of the bimetal 67, and subsequently, the contact point 73 and the conduction plate 68 come in contact with each other, and accordingly, that triggers the flow of an overcurrent to the conduction plate 68, and the wiring 69 connected to the fixation heater 43 is cut off. As a result, the power supply to the fixation heater 47 is cut off, and the overheat of the heat roller 42 is prevented.

In the fixing section 20, even if the bimetal 67 of each of the thermostats 48 is not thermally deformed, when the temperature is raised due to the further overheat up to a temperature (for example, about 260° C.) at which the bearing member 51 is softened, the bearing member 51 is softened. Then, since the heat roller 42 is moved by the press urging force from the pressure roller 44 in the urging direction, that is, upward, it presses the respective heat conduction members 71, and as a result, the projection member 72 of the bimetal 67 of each of the thermostats 48 is mechanically pressed by the heat conduction member 71, and each of the bimetals 67 is mechanically deformed by that. Then, the bimetal 67 and the contact point 73 come in contact with each other by the mechanical deformation of the bimetal 67, and subsequently, the contact point 73 and the conduction plate 68 come in contact with each other. As a result, the flow of an overcurrent to the conduction plate 68, and the wiring 69 connected to the fixation heater 43 is cut off. According to the above, the power supply to the fixation heater 47 is cut off, and the further overheat of the heat roller 42 can be certainly prevented.

That is, in the fixing section 20, when the heat roller 42 is excessively heated, the power supply to the fixation heater 47 can be cut off by the thermal deformation of the bimetal 67 of each of the thermostats 48, and further, even if the bimetal 67 is not thermally deformed, the bearing member 51 is softened, so that the heat roller 42 supported by the bearing member 51 is moved upward, and comes in contact with the respective heat conduction members 71 to mechanically cut off the power supply. That is, at the time of the overheat, the heat roller 42 is certainly moved upward by the press contact of the pressure roller 44, and is mechanically brought into contact with the heat conduction member, so that the power supply can be cut off. Thus, by the cutoff of the power supply as stated above, the responsiveness can be improved, the power supply to the fixation heater 47 can be certainly cut off, and the certain overheat prevention can be achieved.

In the fixing section 20, and in each of the thermostats 48, the heat conduction member 71 intervenes between the bimetal 67 and the heat roller 42, and the heat conduction member 71 is made to act on the projection member 72 of the bimetal 67. That is, when the surface of the heat roller 42 is overheated, the heat is conducted to the projection member 72 of the bimetal 67 through the heat conduction member 71, so that the bimetal 67 is thermally deformed, and the power supply to the fixation heater 47 is cut off. When the surface of the heat roller 42 reaches the softening and melting temperature of the bearing member 51, the bimetal 67 is mechanically deformed by the pressing of the heat conduction member 71 due to the heat roller 42, and the power supply to the fixation heater 47 is cut off. Thus, cutting off of the power supply, that is, the cutoff of the power supply by the thermal deformation of the bimetal 67 of each of the thermostats 48 and the cutting off of the power supply by the mechanical deformation of the bimetal 67 by the pressing of the heat conduction member 71 are provided compactly, and the responsiveness can be improved.

In the fixing section 20, even if a member for urging the heat roller 42 is not specially provided, when the surface of the heat roller 42 reaches the softening and melting temperature of the bearing member 51, the pressure roller 44 presses the heat roller 42, and the heat roller 42 can be brought into contact with the bimetal 67 through the heat conduction member 71, and accordingly, the structure can be simplified and the number of parts can be reduced.

In the fixing section 20, and in each of the thermostats 48, since the projection member 72 of the bimetal 67 comes in contact with the surface of the heat roller 42 through the heat conduction member 71, the certain contact with the surface of the heat roller 42 can be ensured by this projection member 72. Thus, more certain overheat prevention can be achieved.

In each of the thermostats 48, since the bimetal 67 comes in contact with the fixation area of the heat roller 42 through the heat conduction member 71 at the time of the overheat, the power supply to the fixation heater 47 can be quickly cut off in the case where the fixation area is overheated to a temperature higher than the set thermal fixation temperature. Thus, more certain overheat prevention can be achieved.

Further, since the heat conduction member 71 is provided so that in the normal state, it is always in non-contact with the fixation area of the surface of the heat roller 42, it does not influence the toner image of the sheet 3 held between the heat roller 42 and the pressure roller 44 and thermally fixed, and as compared with the case where it is always in contact, the mutual damage of the heat conduction member 71 and the heat roller 42 can be reduced, and the durability of the apparatus can be improved.

In the fixing section 20, as shown in FIG. 3, the heat conduction member 71 of each of the thermostats 48 is supported at the upstream side of each of the thermostats 48 in the rotation direction of the heat roller 42, even in the case where the front end of the sheet 3 sent out from between the heat roller 42 and the pressure roller 44 at the conveyance direction downstream side is wound around the heat roller 42, it is possible to reduce the damage of each of the heat conduction members 71 by the contact with the wound sheet 3.

In the fixing section 20, and in the first thermostat 48*a*, since the first heat conduction member 71*a* is provided at the bimetal casing 66, the first heat conduction member 71*a*, together with the bimetal casing 66, can be assembled, so that the certain overheat prevention can be achieved by the certain assembly.

In the second thermostat 48*b*, since the second heat conduction member 71*b* is provided at the erection frame 56 different from the bimetal casing 66, the degree of freedom in layout can be raised at the assembly, and efficient arrangement can be achieved.

Since the laser printer 1 includes the fixing section 20 which can achieve the certain overheat prevention in the above described way, the reliability of the apparatus can be improved.

In the above description, the respective heat conduction members 71 are made to intervene between the respective bimetals 67 and the heat roller 42 so that in the normal state, the front surfaces are always in contact with the projection members 72 of the respective bimetals 67, and the back surfaces face the surface of the heat roller 42 in the fixation area of the heat roller 42 while being usually spaced therefrom by the slight gap. However, for example, the thermostat 48 is disposed to face the outside of the fixation area on the surface of the heat roller 42, and as shown in FIG. 9, the heat conduction member 71 may be made to intervene between the bimetal 67 and the heat roller 42 so that in the normal state, its front surface is always in contact with the projection member 72 of the bimetal 67, and its back surface is always in contact with the outside of the fixation area on the surface of the heat roller 42.

In the case where the heat conduction member 71 is brought into contact with both the surfaces of the bimetal 67 and the heat roller 42 as stated above, when the surface of the heat roller 42 is excessively heated and reaches the thermal deformation temperature of the bimetal 67, the bimetal 67 exposed toward the heat roller 42 comes in contact with the surface of the heat roller 42 without the intermediary of air and cuts off the power supply. That is, heat from the surface of the heat roller 42 is first conducted to the heat conduction member 71, and is next conducted from the heat conduction member 71 to the bimetal 67, and the bimetal 67 is thermally deformed by the conducted heat to cut off the power supply. Thus, as compared with the conduction through air, the responsiveness can be improved, the power supply to the fixation heater 43 can be quickly cut off, and the certain overheat prevention can be achieved.

Figure 9:
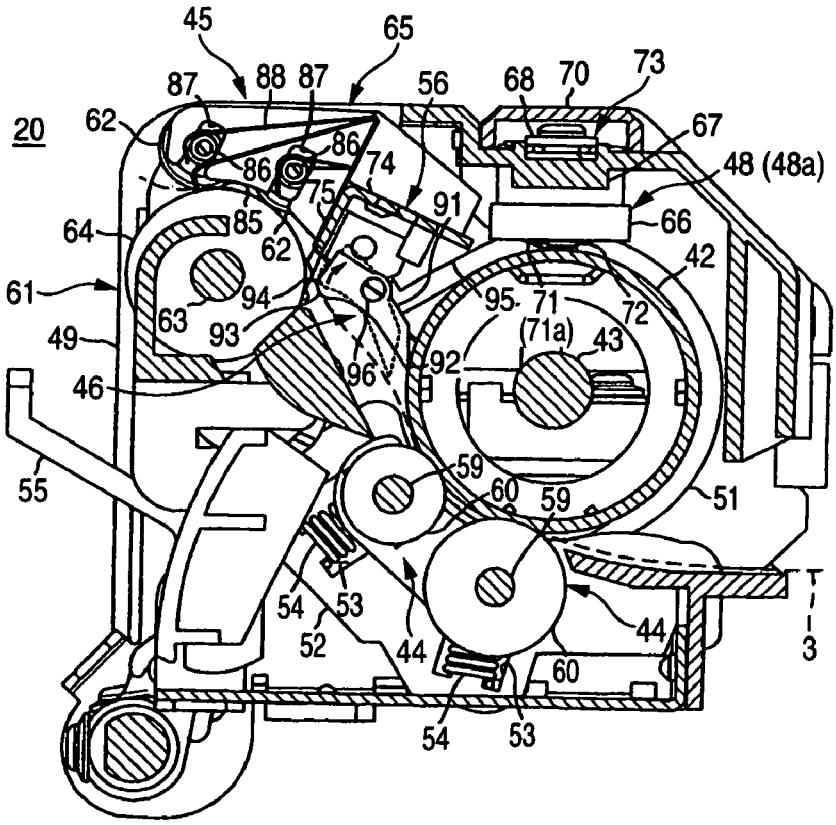
FIG. 9 is a sectional view of another embodiment (in which a heat conduction member is always in contact with both a heat roller and a bimetal) of the fixing part of the laser printer.

In the configuration shown in FIG. 9, since the bimetal 67 comes in contact with the surface of the heat roller 42 through the heat conduction member 71 having the thermal conductivity higher than the air, the quick responsiveness can be certainly ensured.

In the configuration shown in FIG. 9, since the heat conduction member 71 is always brought into contact with the surface of the heat roller 42 at the outside of the fixation area, even if these are worn down by the mutual contact of the surfaces of the heat conduction member 71 and the heat roller 42, the influence on the thermal fixation can be reduced.

Figure 10:
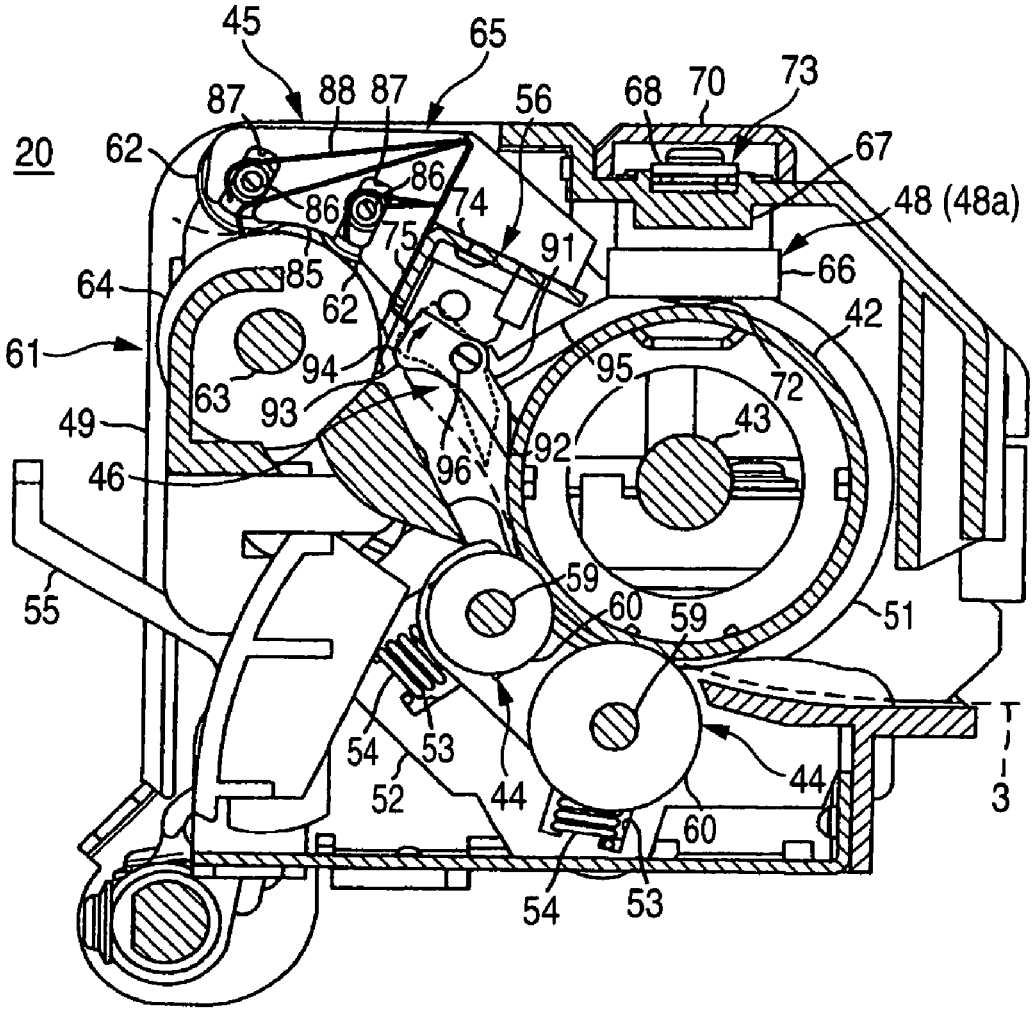
FIG. 10 is a sectional view of another embodiment (in which a bimetal is in direct contact with a heat roller) of the fixing part of the laser printer.

In the configuration shown in FIG. 9, although the bimetal 67 and the surface of the heat roller 42 are brought into contact with each other through the heat conduction member 71, for example, as shown in FIG. 10, the heat conduction member 71 is not provided, and the projection member 72 of the bimetal 67 and the surface of the heat roller 42 may be brought into direct contact with each other at the outside of the fixation area on the surface of the heat roller 42.

As described above, also when the projection member 72 of the bimetal 67 and the surface of the heat roller 42 are brought into direct contact with each other, the quick responsiveness can be certainly ensured.

In the configuration shown in FIG. 10, since the projection member 72 of the bimetal 67 is brought into contact at the outside of the fixation area on the surface of the heat roller 42, similarly to the above, even if these are worn down by the mutual contact of the projection member 72 of the bimetal 67 and the surface of the heat roller 42, the influence on the thermal fixation can be reduced.

In the above description, although the projection member 72 is provided at the bimetal 67 of each of the thermostats 48, a projection member projecting toward the surface of the heat roller 42 may be provided at, for example, the heat conduction member 71 for the purpose of contact with the surface of the heat roller 42.

According to the present invention, both cutting off the power supply, that is, cutting off the power supply by the thermal deformation of the bimetal of the thermal cutoff unit and cutting off the power supply by the mechanical deformation of the bimetal of the thermal cutoff unit by the switch unit, can be provided compactly, and the responsiveness can be improved.

According to the present invention, in the case where the fixing member is not in the overheat state, the switch unit is in non-contact with the fixing member, and accordingly, as compared with a case of contact, their mutual damages can be reduced, and the durability of the device can be improved.

According to the present invention, since the switch unit is supported at the upstream side of the thermal cutoff unit in the rotation direction of the fixing roller, even in the case where the fixing member is wound around the fixing roller, the damage of the switch unit by the wound fixing member can be reduced.

According to the present invention, when the fixing member is excessively heated, the bimetal provided so as to be exposed toward the fixing member comes in contact with the fixing member without the intermediary of the air and cuts off the power supply. That is, the heat due to the overheat is conducted to the bimetal from the fixing member without the intermediary of the air, and the bimetal is thermally deformed to cut off the power supply. Thus, as compared with the conduction through the air, the responsiveness can be improved, the power supply to the heating unit can be quickly cut off, and the certain overheat prevention can be achieved.

According to the present invention, since the bimetal comes in direct contact with the fixing member, the quick responsiveness can be certainly ensured.

According to the present invention, since the bimetal comes in contact with the fixing member through the member having the high thermal conductivity, the quick responsiveness can be certainly ensured.

According to the present invention, since the bimetal or the member having the high thermal conductivity comes in contact with the fixation area of the fixing member at the time of overheat, in the case where the fixation area is overheated to a temperature higher than a fixation temperature, the power supply to the heating unit can be quickly cut off. Thus, more certain overheat prevention can be achieved.

According to the present invention, at the time of the overheat, the fixing member supported by the supporting member is moved and comes in contact with the bimetal or the member having the high thermal conductivity to cut off the power supply. Thus, the responsiveness at the time of the overheat can be certainly ensured, and the certain heat prevention can be achieved.

According to the present invention, since the bimetal or the member having the high thermal conductivity is in non-contact with the fixing member in the case where the fixing member is not in the overheat state, as compared with a case of contact, their mutual damage can be reduced, and the durability of the device can be improved.

According to the present invention, the bimetal or the member having the high thermal conductivity can ensure the certain contact with the fixing member by the projection. Thus, more certain overheat prevention can be achieved.

According to the present invention, when the bearing member is softened by the overheat, the fixing member is moved to the switch unit or the bimetal by the urging force of the press member. Thus, the certain movement of the fixing member at the time of the overheat can be ensured, and the certain overheat prevention can be achieved.

According to the present invention, at the time of the overheat, even if a press member is not specially provided, the fixing member is pressed by the pressure roller, and the fixing member can be brought into contact with the switch unit, the bimetal or the member having the high thermal conductivity. Thus, the structure can be simplified, and the number of parts can be reduced.

According to the present invention, the bimetal, together with the housing, can be assembled, and the certain overheat prevention can be achieved by the certain assembly.

According to the present invention, since the switch unit or the member having the high thermal conductivity is provided in the member different from the housing, the degree of freedom in layout can be raised at the assembly, and efficient arrangement can be achieved.

Since the image forming apparatus as stated above includes the thermal fixing device which can achieve the certain overheat prevention, the reliability of the apparatus can be improved.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A thermal fixing device comprising:

a fixing member disposed to be in contact with a fixation medium;

a heating unit configured to heat the fixing member with power supplied thereto;

a supporting unit configured to movably support the fixing member and to move the fixing member when the fixing member is overheated by the heating unit;

a switch disposed to be in contact with the fixing member when the fixing member is moved by the supporting unit, and configured to mechanically cut off the power supplied to the heating unit when the switch contacts with the fixing member; and a thermal cutoff unit having a bimetal in which deforms by heat, disposed to face the fixing member, and configured to cut off the power supplied to the heating unit by deformation of the bimetal.

2. The thermal fixing device as claimed in claim 1, wherein the switch mechanically deforms the bimetal to cut off the power supplied to the heating unit.

3. The thermal fixing device as claimed in claim 1, wherein the switch is configured to become in non-contact with the fixing member when the fixing member is not overheated.

4. The thermal fixing device as claimed in claim 1, wherein the fixing member comprises a fixing roller, and wherein the switch is disposed at a position upstream of the thermal cutoff unit with respect to a rotation direction of the fixing roller.

5. The thermal fixing device as claimed in claim 1 further comprising a pressing member configured to urge the fixing member towards the switch, wherein the supporting member comprises a bearing member that allows the pressing member to move the fixing member when the bearing member is softened by the overheat.

6. The thermal fixing device as claimed in claim 5, wherein the pressing member comprises a pressure roller that holds the fixation medium against the fixing member, and wherein the switch is configured to be in contact with an opposite side of the fixing device with respect to the pressure roller.

7. The thermal fixing device as claimed in claim 1, wherein the thermal cutoff unit comprises a housing that contains the bimetal and the switch.

8. The thermal fixing device as claimed in claim 1, wherein the thermal cutoff unit comprises a housing that contains the bimetal, and wherein the switch is disposed separately from the housing.

9. A thermal fixing device comprising:

a fixing member disposed to be in contact with a fixation medium;

a heating unit configured to heat the fixing member with power supplied thereto;

a thermal cutoff unit having a bimetal that is deformed by heat and exposed toward the fixing member to be in contact therewith without intermediary of air, and configured to cut off the power supplied to the heating unit by deformation of the bimetal; and a supporting unit configured to movably support the fixing member, wherein the fixing member is configured to be in contact with the bimetal through the movement thereof due to the overheat, and is configured to cut off the power supplied to the heating unit by contacting with the bimetal.

10. The thermal fixing device as claimed in claim 9, wherein the bimetal is configured to be in direct contact with the fixing member.

11. The thermal fixing device as claimed in claim 9, wherein the fixing member has a fixation area that is to be in contact with the fixation medium, and wherein the bimetal is configured to be in contact with the fixation area of the fixing member.

12. The thermal fixing device as claimed in claim 9, wherein the bimetal is configured to become in non-contact with the fixing member when the fixing member is not overheated.

13. The thermal fixing device as claimed in claim 9, wherein the bimetal comprises a projection configured to be in contact with the fixing member.

14. The thermal fixing device as claimed in claim 9, further comprising a pressing member configured to urge the fixing member towards the bimetal and comprises a pressure roller that holds the fixation medium against the fixing member, wherein the supporting unit comprises a bearing member that allows the pressing member to move the fixing member when the bearing member is softened by the overheat, and wherein the bimetal is configured to be in contact with an opposite side of the fixing device with respect to the pressure roller.

15. The thermal fixing device as claimed in claim 9, wherein the fixing member has a fixation area that is to be in contact with the fixation medium, and wherein the heat conductive member is configured to be in contact with the fixation area of the fixing member.

16. The thermal fixing device as claimed in claim 9, wherein the heat conductive member is configured to become in non-contact with the fixing member when the fixing member is not overheated.

17. The thermal fixing device as claimed in claim 9, wherein the heat conductive member comprises a projection configured to be in contact with the fixing member.

18. The thermal fixing device as claimed in claim 9, further comprising:

a switch disposed to be in contact with the fixing member when the fixing member is moved by the supporting unit, and configured to cut off power supplied to the heating unit when the switch contacts the fixing member.

19. The thermal fixing device as claimed in claim 18, further comprising:

a pressing member configured to urge the fixing member towards the switch or the bimetal and comprising a pressure roller that holds the fixation medium against the fixing member; and a supporting member that holds the fixing member, the supporting member comprising a bearing member that allows the pressing member to move the fixing member when the bearing member is softened by the overheat, and wherein the heat conductive member is configured to be in contact with an opposite side of the fixing device with respect to the pressure roller.

20. The thermal fixing device as claimed in claim 18, wherein the thermal cutoff unit comprises a housing that contains the heat conductive member and the switch.

21. The thermal fixing device as claimed in claim 18, wherein the thermal cutoff unit comprises a housing that contains the heat conductive member, and wherein the switch is disposed separately from the housing.

22. An image forming apparatus comprising:

a sheet feeding section configured to feed a sheet; and an image forming section configured to form an image on the sheet fed by the sheet feeding section, wherein the image forming section includes a thermal fixing device comprising:

a fixing member disposed to be in contact with the sheet;

a heating unit configured to heat the fixing member with power supplied thereto;

a supporting unit configured to movably support the fixing member and to move the fixing member when the fixing member is overheated by the heating unit;

a switch disposed to be in contact with the fixing member when the fixing member is moved by the supporting unit, and configured to mechanically cut off the power supplied to the heating unit when being contacted with the fixing member; and a thermal cutoff unit having a bimetal in which deforms by heat, disposed to face the fixing member, and configured to cut off the power supplied to the heating unit by deformation of the bimetal.

23. The image forming apparatus as claimed in claim 22, wherein the switch mechanically deforms the bimetal to cut off the power supplied to the heating unit.

24. The image forming apparatus as claimed in claim 22, wherein the switch is configured to become in non-contact with the fixing member when the fixing member is not overheated.

25. The image forming apparatus as claimed in claim 22, wherein the fixing member comprises a fixing roller, and wherein the switch is disposed at a position upstream of the thermal cutoff unit with respect to a rotation direction of the fixing roller.

26. The image forming apparatus as claimed in claim 22, wherein the thermal fixing device further comprises a pressing member configured to urge the fixing member towards the switch, wherein the supporting member comprises a bearing member that allows the pressing member to move the fixing member when the bearing member is softened by the overheat.

27. The image forming apparatus as claimed in claim 26, wherein the pressing member comprises a pressure roller that holds the sheet against the fixing member, and wherein the switch is configured to be in contact with an opposite side of the fixing device with respect to the pressure roller.

28. The image forming apparatus as claimed in claim 22, wherein the thermal cutoff unit comprises a housing that contains the bimetal and the switch.

29. The image forming apparatus as claimed in claim 22, wherein the thermal cutoff unit comprises a housing that contains the bimetal, and wherein the switch is disposed separately from the housing.

30. An image forming apparatus comprising:

a sheet feeding section configured to feed a sheet; and an image forming section configured to form an image on the sheet fed by the sheet feeding section, the image forming section including a thermal fixing device comprising:

a fixing member disposed to be in contact with the sheet;

a heating unit configured to heat the fixing member with power supplied thereto;

a thermal cutoff unit having a bimetal that is deformed by heat and exposed toward the fixing member to be in contact therewith without intermediary of air, and configured to cut off the power supplied to the heating unit by deformation of the bimetal; and a supporting unit configured to movably support the fixing member, wherein the fixing member is configured to be in contact with the bimetal through the movement thereof due to the overheat, and is configured to cut off the power supplied to the heating unit by contacting with the bimetal.

31. The image forming apparatus as claimed in claim 30, wherein the bimetal is configured to be in direct contact with the fixing member.

32. The image forming apparatus as claimed in claim 30, wherein the fixing member has a fixation area that is to be in contact with the sheet, and wherein the bimetal is configured to be in contact with the fixation area of the fixing member.

33. The image forming apparatus as claimed in claim 30, wherein the bimetal is configured to become in non-contact with the fixing member when the fixing member is not overheated.

34. The image forming apparatus as claimed in claim 30, wherein the bimetal comprises a projection configured to be in contact with the fixing member.

35. The image forming apparatus as claimed in claim 30, wherein the thermal fixing device further comprises a pressing member configured to urge the fixing member towards the bimetal and comprises a pressure roller that holds the sheet against the fixing member, wherein the supporting unit comprises a bearing member that allows the pressing member to move the fixing member when the bearing member is softened by the overheat, and wherein the bimetal is configured to be in contact with an opposite side of the fixing device with respect to the pressure roller.

36. The image forming apparatus as claimed in claim 30, wherein the fixing member has a fixation area that is to be in contact with the sheet, and wherein the heat conductive member is configured to be in contact with the fixation area of the fixing member.

37. The image forming apparatus as claimed in claim 30, wherein the heat conductive member is configured to become in non-contact with the fixing member when the fixing member is not overheated.

38. The image forming apparatus as claimed in claim 30, wherein the heat conductive member comprises a projection configured to be in contact with the fixing member.

39. The image forming apparatus as claimed in claim 30, further comprising:

a switch disposed to be in contact with the fixing member when the fixing member is moved by the supporting unit, and configured to cut off the power supplied to the heating unit when the switch contacts the fixing member.

40. The image forming apparatus as claimed in claim 39, wherein the thermal fixing device further comprises:

a pressing member configured to urge the fixing member towards the switch or the bimetal and comprising a pressure roller that holds the sheet against the fixing member, wherein the supporting unit comprises a bearing member that allows the pressing member to move the fixing member when the bearing member is softened by the overheat, and wherein the heat conductive member is configured to be in contact with an opposite side of the fixing device with respect to the pressure roller.

41. The image forming apparatus as claimed in claim 39, wherein the thermal cutoff unit comprises a housing that contains the heat conductive member and the switch.

42. The image forming apparatus as claimed in claim 39, wherein the thermal cutoff unit comprises a housing that contains the heat conductive member, and wherein the switch is disposed separately from the housing.

43. A thermal fixing device comprising:

a fixing member disposed to be in contact with a fixation medium;

a heating unit which generates heat by electrical power supplied thereto, the fixing member being heated by the heat generated by the heating member;

a supporting member that supports the fixing member, the supporting member being softened when the fixing member is overheated by the heating unit;

a switch capable of being actuated such that the electrical power supplied to the heating unit is cut off; and a bimetal disposed to face the fixing member, wherein the fixing member moves toward the bimetal when the supporting member is softened, the bimetal is deformed by movement of the fixing member, and the switch is actuated by the deformation of the bimetal, and wherein the bimetal is deformed by heat when the fixing member is overheated, and the switch is actuated by deformation of the bimetal.

44. A thermal fixing device comprising:

a fixing member disposed to be in contact with a fixation medium;

a heating unit configured to heat the fixing member with power supplied thereto;

a thermal cutoff unit having a bimetal that is deformed by heat and exposed toward the fixing member to be in contact therewith without intermediary of air, and configured to cut off the power supplied to the heating unit by deformation of the bimetal, the bimetal being configured to be in contact with the fixing member through a heat conductive member having a high thermal conductivity; and a supporting unit configured to movably support the fixing member, wherein the fixing member is configured to be in contact with the heat conductive member through the movement thereof due to the overheat, and is configured to cut off the power supplied to the heating unit by contacting with the heat conductive member.

45. The thermal fixing device as claimed in claim 44, wherein the bimetal is configured to be in direct contact with the fixing member.

46. The thermal fixing device as claimed in claim 44, wherein the fixing member has a fixation area that is to be in contact with the fixation medium, and wherein the bimetal is configured to be in contact with the fixation area of the fixing member.

47. The thermal fixing device as claimed in claim 44, wherein the bimetal is configured to become in non-contact with the fixing member when the fixing member is not overheated.

48. The thermal fixing device as claimed in claim 44, wherein the bimetal comprises a projection configured to be in contact with the fixing member.

49. The thermal fixing device as claimed in claim 44, further comprising a pressing member configured to urge the fixing member towards the bimetal and comprising a pressure roller that holds the fixation medium against the fixing member, wherein the supporting unit comprises a bearing member that allows the pressing member to move the fixing member when the bearing member is softened by the overheat, and wherein the bimetal is configured to be in contact with an opposite side of the fixing device with respect to the pressure roller.

50. The thermal fixing device as claimed in claim 44, wherein the fixing member has a fixation area that is to be in contact with the fixation medium, and wherein the heat conductive member is configured to be in contact with the fixation area of the fixing member.

51. The thermal fixing device as claimed in claim 44, wherein the heat conductive member is configured to become in non-contact with the fixing member when the fixing member is not overheated.

52. The thermal fixing device as claimed in claim 44, wherein the heat conductive member comprises a projection configured to be in contact with the fixing member.

53. The thermal fixing device as claimed in claim 44, further comprising:

a switch disposed to be in contact with the fixing member when the fixing member is moved by the supporting unit, and configured to cut off power supplied to the heating unit when the switch contacts the fixing member.

54. The thermal fixing device as claimed in claim 53, further comprising:

a pressing member configured to urge the fixing member towards the switch or the bimetal and comprising a pressure roller that holds the fixation medium against the fixing member; and a supporting member that holds the fixing member, the supporting member comprising a bearing member that allows the pressing member to move the fixing member when the bearing member is softened by the overheat, and wherein the heat conductive member is configured to be in contact with an opposite side of the fixing device with respect to the pressure roller.

55. The thermal fixing device as claimed in claim 53, wherein the thermal cutoff unit comprises a housing that contains the heat conductive member and the switch.

56. The thermal fixing device as claimed in claim 53, wherein the thermal cutoff unit comprises a housing that contains the heat conductive member, and wherein the switch is disposed separately from the housing.

57. An image forming apparatus comprising:

a sheet feeding section configured to feed a sheet; and an image forming section configured to form an image on the sheet fed by the sheet feeding section, the image forming section including a thermal fixing device comprising:

a fixing member disposed to be in contact with the sheet;

a heating unit configured to heat the fixing member with power supplied thereto;

a thermal cutoff unit having a bimetal that is deformed by heat and exposed toward the fixing member to be in contact therewith without intermediary of air, and configured to cut off the power supplied to the heating unit by deformation of the bimetal, the bimetal being configured to be in contact with the fixing member through a heat conductive member having a high thermal conductivity; and a supporting unit configured to movably support the fixing member, wherein the fixing member is configured to be in contact with the heat conductive member through the movement thereof due to the overheat, and is configured to cut off the power supplied to the heating unit by contacting with the heat conductive member.

58. The image forming apparatus as claimed in claim 57, wherein the bimetal is configured to be in direct contact with the fixing member.

59. The image forming apparatus as claimed in claim 57, wherein the fixing member has a fixation area that is to be in contact with the sheet, and wherein the bimetal is configured to be in contact with the fixation area of the fixing member.

60. The image forming apparatus as claimed in claim 57, wherein the bimetal is configured to become in non-contact with the fixing member when the fixing member is not overheated.

61. The image forming apparatus as claimed in claim 57, wherein the bimetal comprises a projection configured to be in contact with the fixing member.

62. The image forming apparatus as claimed in claim 57, wherein the thermal fixing device further comprises a pressing member configured to urge the fixing member towards the bimetal and comprises a pressure roller that holds the sheet against the fixing member, wherein the supporting member comprises a bearing member that allows the pressing member to move the fixing member when the bearing member is softened by the overheat, and wherein the bimetal is configured to be in contact with an opposite side of the fixing device with respect to the pressure roller.

63. The image forming apparatus as claimed in claim 57, wherein the fixing member has a fixation area that is to be in contact with the sheet, and wherein the heat conductive member is configured to be in contact with the fixation area of the fixing member.

64. The image forming apparatus as claimed in claim 57, wherein the heat conductive member is configured to become in non-contact with the fixing member when the fixing member is not overheated.

65. The image forming apparatus as claimed in claim 57, wherein the heat conductive member comprises a projection configured to be in contact with the fixing member.

66. The image forming apparatus as claimed in claim 57, further comprising:

a switch disposed to be in contact with the fixing member when the fixing member is moved by a supporting unit, and configured to cut off the power supplied to the heating unit when the switch contacts the fixing member.

67. The image forming apparatus as claimed in claim 66, wherein the thermal fixing device further comprises:

a pressing member configured to urge the fixing member towards the switch or the bimetal and comprising a pressure roller that holds the sheet against the fixing member, wherein the supporting unit comprises a bearing member that allows the pressing member to move the fixing member when the bearing member is softened by the overheat, and wherein the heat conductive member is configured to be in contact with an opposite side of the fixing device with respect to the pressure roller.

68. The image forming apparatus as claimed in claim 66, wherein the thermal cutoff unit comprises a housing that contains the heat conductive member and the switch.

69. The image forming apparatus as claimed in claim 66, wherein the thermal cutoff unit comprises a housing that contains the heat conductive member, and wherein the switch is disposed separately from the housing.

* * * * *